US010300526B2

(12) United States Patent
Propheter-Hinckley et al.

(10) Patent No.: US 10,300,526 B2
(45) Date of Patent: May 28, 2019

(54) CORE ASSEMBLY INCLUDING STUDDED SPACER

(71) Applicant: UNITED TECHNOLOGIES CORPORATION, Hartford, CT (US)

(72) Inventors: Tracy A. Propheter-Hinckley, Manchester, CT (US); James T. Auxier, Bloomfield, CT (US); Eric A. Hudson, Harwinton, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 570 days.

(21) Appl. No.: 14/616,940

(22) Filed: Feb. 9, 2015

(65) Prior Publication Data

US 2018/0161851 A1 Jun. 14, 2018

Related U.S. Application Data

(60) Provisional application No. 61/946,010, filed on Feb. 28, 2014, provisional application No. 61/973,382, filed on Apr. 1, 2014.

(51) Int. Cl.
*B22C 9/10* (2006.01)
*B22C 21/14* (2006.01)

(52) U.S. Cl.
CPC ..... *B22C 9/108* (2013.01); *B22C 9/101* (2013.01)

(58) Field of Classification Search
CPC ..... B22C 9/10; B22C 9/103; B22C 9/108; B22C 21/14
USPC ..... 164/369, 370, 397, 398, 399, 400
See application file for complete search history.

(56) References Cited

U.S. PATENT DOCUMENTS

| | | | | |
|---|---|---|---|---|
| 974,218 A | | 11/1910 | Wells | |
| 1,819,765 A | | 8/1931 | Bumbaugh | |
| 2,958,106 A | | 11/1960 | Fobus | |
| 5,296,308 A | | 3/1994 | Caccavale et al. | |
| 5,505,250 A | | 4/1996 | Jago | |
| 5,853,044 A | * | 12/1998 | Wheaton et al. | B22C 7/02 164/30 |
| 5,950,705 A | * | 9/1999 | Huang | B22C 9/04 164/122.1 |

(Continued)

FOREIGN PATENT DOCUMENTS

| | | |
|---|---|---|
| DE | 671951 | 2/1939 |
| EP | 0556946 B1 | 4/1998 |

(Continued)

OTHER PUBLICATIONS

Extended European Search Report for European Application No. 15156813.6, dated Aug. 5, 2015.

(Continued)

*Primary Examiner* — Kevin P Kerns
(74) *Attorney, Agent, or Firm* — Carlson, Gaskey & Olds, P.C.

(57) ABSTRACT

A core assembly for a casting system according to an exemplary aspect of the present disclosure includes, among other things, a core that includes a body and at least one hole formed through the body and a spacer that extends through the at least one hole. The spacer includes a stud portion and a chaplet portion configured to abut a surface of the body that circumscribes the at least one hole.

18 Claims, 11 Drawing Sheets

(56) References Cited

U.S. PATENT DOCUMENTS

| | | | | |
|---|---|---|---|---|
| 6,186,217 | B1 * | 2/2001 | Sikkenga et al. | B22C 7/026 164/137 |
| 6,244,327 | B1 * | 6/2001 | Frasier | B22C 9/04 164/133 |
| 6,505,678 | B2 * | 1/2003 | Mertins | B22C 21/14 164/340 |
| 6,557,621 | B1 * | 5/2003 | Dierksmeier et al. | B22C 9/103 164/368 |
| 6,626,230 | B1 | 9/2003 | Woodrum et al. | |
| 7,174,945 | B2 | 2/2007 | Beals et al. | |
| 7,322,396 | B2 | 1/2008 | Govern et al. | |
| 8,251,123 | B2 | 8/2012 | Farris et al. | |
| 8,302,668 | B1 | 11/2012 | Bullied et al. | |
| 2005/0189086 | A1 | 9/2005 | Caputo et al. | |
| 2009/0000754 | A1 | 1/2009 | Piggush | |
| 2010/0122789 | A1 | 5/2010 | Piggush et al. | |
| 2010/0219325 | A1 | 9/2010 | Bullied et al. | |
| 2013/0025287 | A1 | 1/2013 | Cunha | |

FOREIGN PATENT DOCUMENTS

| | | | |
|---|---|---|---|
| EP | 2130626 | A1 | 12/2009 |
| EP | 2471613 | A2 | 7/2012 |
| FR | 755534 | | 11/1933 |
| FR | 760624 | | 2/1934 |
| FR | 2874187 | | 2/2006 |
| GB | 191220263 | | 1/1913 |
| GB | 169098 | | 9/1921 |
| GB | 165039 | | 9/1922 |
| GB | 2281238 | A | 3/1995 |

OTHER PUBLICATIONS

Extended European Search Report for Application No. EP 16 17 5517 dated Sep. 15, 2016.

Notice of Opposition for European Patent Application No. 15156813.6 filed Jan. 22, 2018.

* cited by examiner

CORE ASSEMBLY INCLUDING STUDDED SPACER

CROSS REFERENCE TO RELATED APPLICATIONS

This application claims priority to U.S. Provisional Application No. 61/946,010 which was filed Feb. 28, 2014, and U.S. Provisional Application No. 61/973,382, which was filed Apr. 1, 2014.

STATEMENT REGARDING FEDERALLY SPONSORED RESEARCH OR DEVELOPMENT

This invention was made with government support under Contract No. N00019-12-D-0002-4Y01, awarded by the United States Navy. The Government therefore has certain rights in this invention.

BACKGROUND

This discourse relates to a casting system, and more particularly to a core assembly that may be employed in a casting system to manufacture a part.

Gas turbine engines are widely used in aircraft propulsion, electric power generation, shift propulsion and pumps. Many gas turbine engine components are cast components. One example casting process is known as investment casting. Investment casting can form metallic parts having relatively complex geometries, such as gas turbine engine parts requiring internal cooling passageways. Blades and vanes are examples of such parts.

The investment casting process typically utilizes a casting system that includes a mold having one or more mold cavities that define a shape generally corresponding to the part to be cast. A wax or ceramic pattern of the part is formed by molding wax or injecting ceramic material around a core assembly of the casting system. A shell is formed around the core assembly in a shelling process to assemble the casting system. The shell is fired to form the casting system including the shell having one or more part defining compartments that include the core assembly. Molten material is communicated into the casting system to cast the part. The shell and core assembly are removed once the molten material cools and solidifies.

Maintaining wall thicknesses to specification during the casting process can be difficult because of the relatively thin-walled constructions of parts that are cast to include relatively complex internal cooling passageways. The spacing between the core assembly and the surrounding shell is one area that must be controlled to maintain wall thicknesses during the casting process.

SUMMARY

A core assembly for a casting system according to an exemplary aspect of the present disclosure includes, among other things, a core that includes a body and at least one hole formed through the body and a spacer that extends through the at least one hole. The spacer includes a stud portion and a chaplet portion configured to abut a surface of the body that circumscribes the at least one hole.

In a further non-limiting embodiment of the foregoing core assembly, the core is a refractory metal core (RMC).

In a further non-limiting embodiment of either of the foregoing core assemblies, the core is a ceramic core.

In a further non-limiting embodiment of any of the foregoing core assemblies, the spacer is made of platinum or a multi-metal composite.

In a further non-limiting embodiment of any of the foregoing core assemblies, the chaplet portion is conical.

In a further non-limiting embodiment of any of the foregoing core assemblies, the chaplet portion includes a skirt that is positioned between the stud portion and another stud portion.

In a further non-limiting embodiment of any of the foregoing core assemblies, the skirt is conical or rounded.

In a further non-limiting embodiment of any of the foregoing core assemblies, at least one filleted cutout is formed in either the stud portion or the chaplet portion.

In a further non-limiting embodiment of any of the foregoing core assemblies, the stud portion includes at least one depth indicator.

In a further non-limiting embodiment of any of the foregoing core assemblies, the chaplet portion is a bent portion of the spacer.

In a further non-limiting embodiment of any of the foregoing core assemblies, the core is assembled to a second core and is spaced from the second core by a bumper or a second spacer.

In a further non-limiting embodiment of any of the foregoing core assemblies, the core is assembled to a second core or a shell and is spaced from the second core or the shell by a second spacer received in a recess of the second core.

In a further non-limiting embodiment of any of the foregoing core assemblies, a second spacer engages the spacer to sandwich the core between the spacer and the second spacer.

In a further non-limiting embodiment of any of the foregoing core assemblies, the spacer and the second spacer are threadably attached together.

In a further non-limiting embodiment of any of the foregoing core assemblies, the spacer and the second spacer are riveted together.

A casting system according to another exemplary aspect of the present disclosure includes, among other things, a first core and a first spacer received through a hole or within a recess in the first core and that spaces the first core from a shell or a second core.

In a further non-limiting embodiment of the foregoing casting system, a second spacer is secured to the first spacer to sandwich the first core.

In a further non-limiting embodiment of either of the foregoing casting systems, the first spacer includes a stud portion and a chaplet portion.

A casting system according to another exemplary aspect of the present disclosure includes, among other things, a spacer assembly that includes a first spacer and a second spacer secured to the first spacer.

In a further non-limiting embodiment of the foregoing casting system, a stud portion of one of the first spacer and the second spacer is received through a bore of the other of the first spacer and the second spacer.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

The various features and advantages of this disclosure will become apparent to those skilled in the art from the following detailed description. The drawings that accompany the detailed description can be briefly described as follows.

DETAILED DESCRIPTION

This disclosure relates to a casting system. The casting system includes a core assembly having a core that includes a body and at least one hole formed through the body. A spacer extends through the hole and includes a stud portion and a chaplet portion. The chaplet portion abuts a portion of the body that circumscribes the hole. One or more spacers may be used to control the spacing between the core and a surrounding shell of the casting system during a casting process. In another embodiment, a spacer assembly is employed to sandwich a core of a core assembly and to space the core from other casting articles of a casting system.

Figure 1:
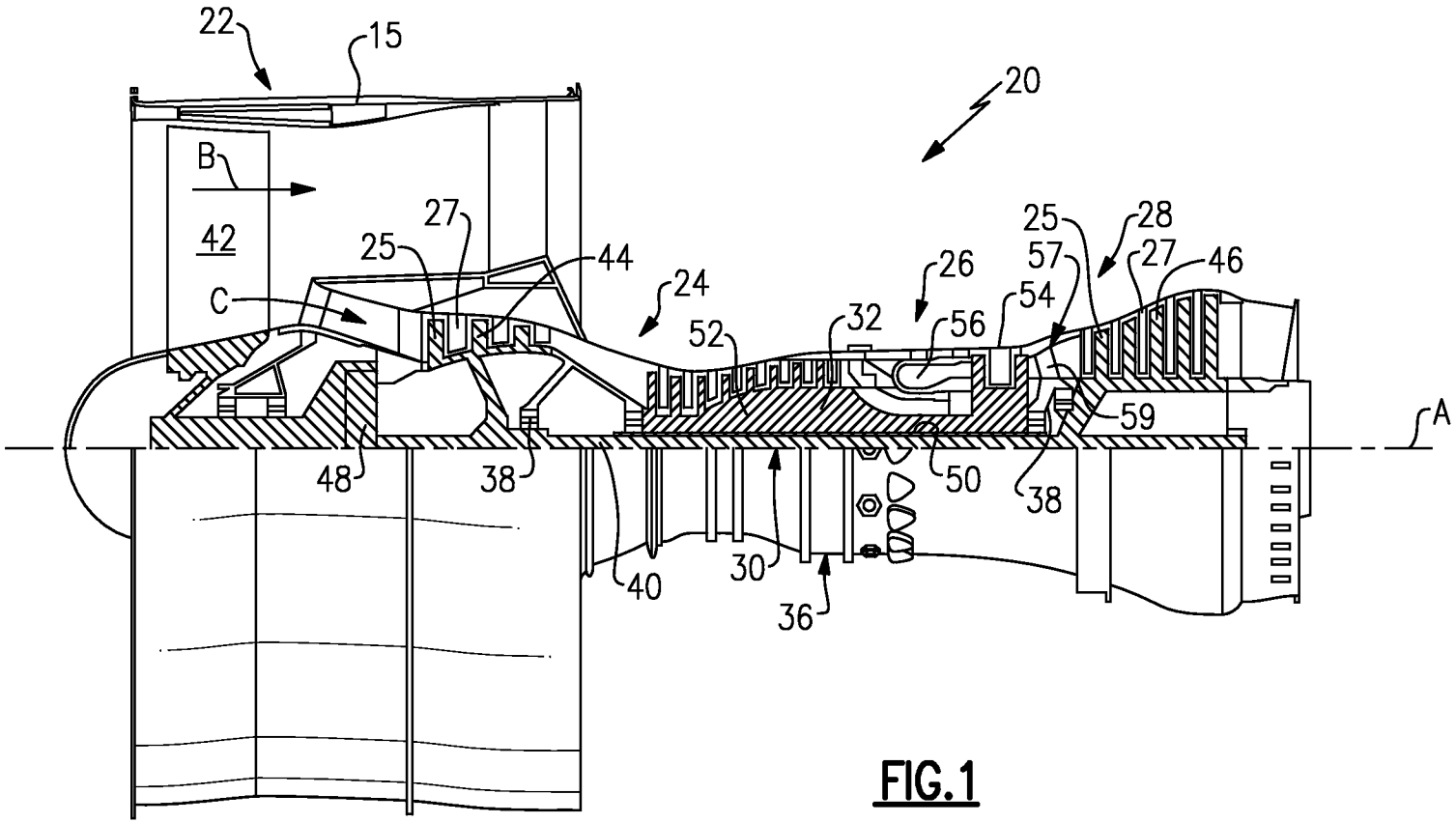
FIG. 1 illustrates a schematic, cross-sectional view of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmenter section (not shown) among other systems or features. The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of the bearing systems 38 may be varied as appropriate to the application.

The low speed spool 30 generally includes an inner shaft 40 that interconnects a fan 42, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via the bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The gear system 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present invention is applicable to other gas turbine engines including direct drive turbofans and turboshafts.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft, with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram} \circ \text{R})/(518.7 \circ \text{R})]^{0.5}$. The "Low corrected fan tip speed" as disclosed herein according to one non-limiting embodiment is less than about 1,150 ft/second (350.5 meters/second).

Each of the compressor section 24 and the turbine section 28 may include alternating rows of rotor assemblies and vane assemblies (shown schematically). For example, the rotor assemblies can carry a plurality of rotating blades 25, while each vane assembly can carry a plurality of vanes 27 that extend into the core flow path C. The blades 25 may either create or extract energy in the form of pressure from the core airflow as it is communicated along the core flow path C. The vanes 27 direct the core airflow to the blades 25 to either add or extract energy.

Figure 2:
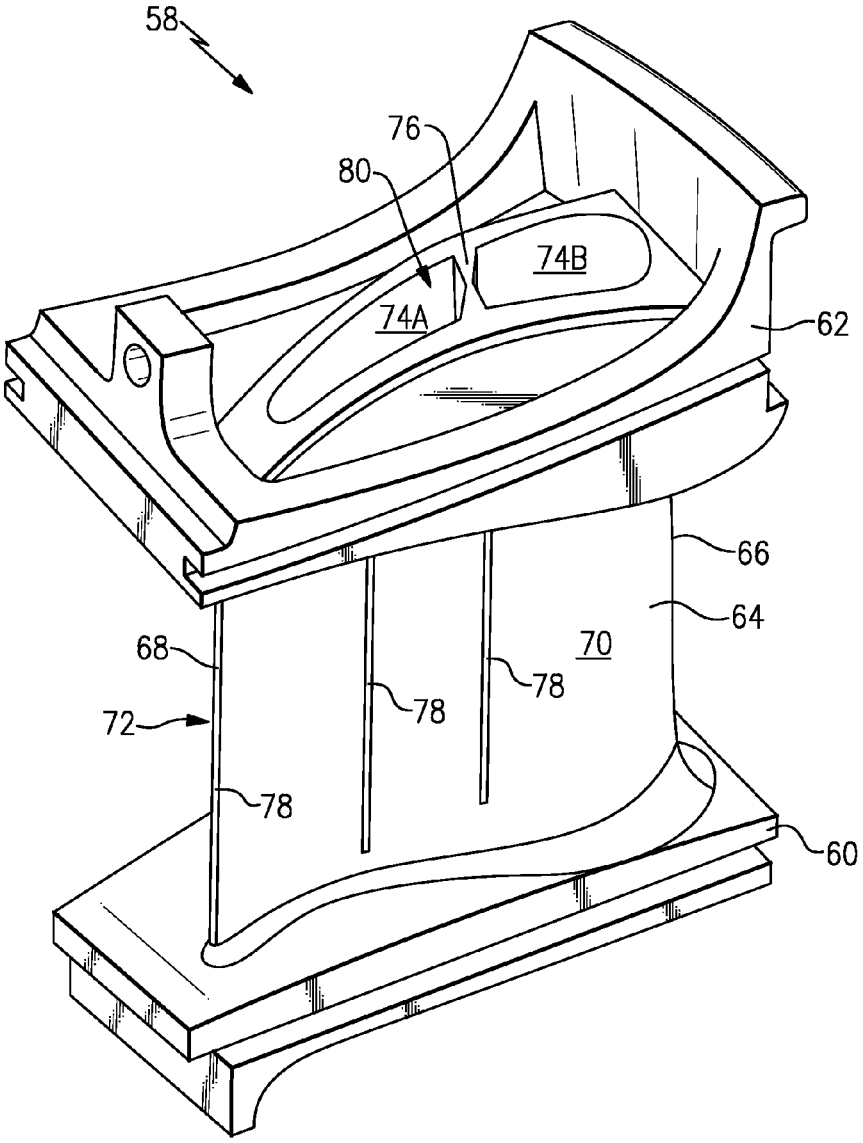
FIG. 2 illustrates a gas turbine engine part that can be manufactured in a casting process.

FIG. 2 illustrates a part 58 that can be cast in a casting process, such as an investment casting process. In one embodiment, the part 58 is a turbine vane. Although the part 58 is illustrated as a turbine vane, the various features of this disclosure are applicable to any cast part, including parts located elsewhere within a gas turbine engine, such as blades, blade outer air seals (BOAS), combustor panels, etc.

In one embodiment, the part 58 includes an inner platform 60, an outer platform 62, and an airfoil 64 that extends between the inner platform 60 and the outer platform 62. The airfoil 64 includes a leading edge 66, a trailing edge 68, a pressure side 70 and a suction side 72. The pressure side 70 and the suction side 72 generally meet at both the leading edge 66 and the trailing edge 68. Although a single airfoil is depicted, other parts are also contemplated, including parts having multiple airfoils (i.e., vane doublets).

The part 58 can include internal cooling passages 74A, 74B that are separated by a rib 76. The internal cooling passages 74A, 74B may include core formed cavities that exit the airfoil 64 at slots 78. The internal cooling passages 74A, 74B and their respective core formed cavities define an internal circuitry 80 for cooling the part 58. The internal cooling passages 74A, 74B and the internal circuitry 80 of the part 58 represent but one example of many potential cooling circuits. In other words, the part 58 could be cast to include various alternative cooling passages and internal circuitry configurations within the scope of this disclosure.

In operation, cooling fluid, such as bleed airflow from a compressor section of a gas turbine engine, is communicated through the internal cooling passages 74A, 74B and is expelled out of the slots 78 to cool the airfoil 64 from the hot combustion gases that are communicated across the airfoil 64 between the leading edge 66 and the trailing edge 68 on both the pressure side 70 and the suction side 72. The cooling fluid may circulate through the internal circuitry 80 to cool the part 58.

Figure 3:
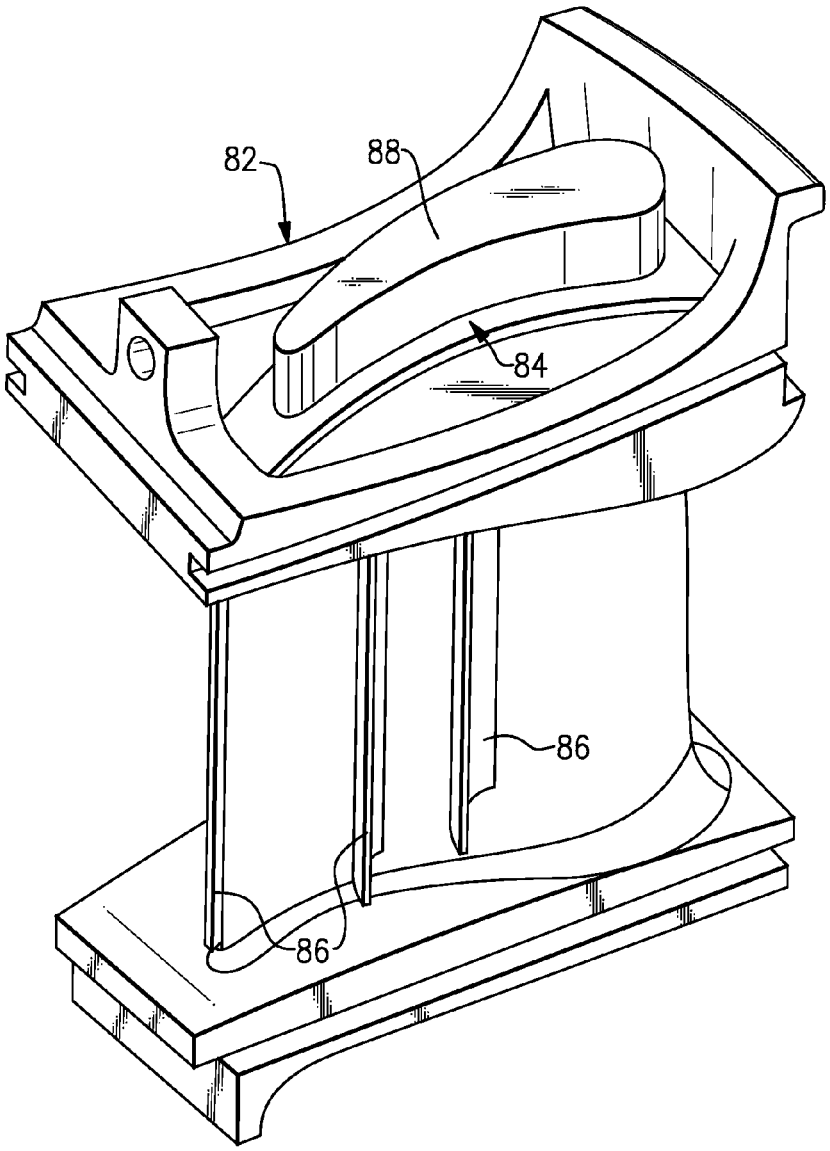
FIG. 3 illustrates a wax pattern of a gas turbine engine part that surrounds a core assembly of a casting system.

FIG. 3 illustrates a wax pattern 82 that can be used to manufacture the part 58 of FIG. 2. The wax pattern 82 surrounds a core assembly 84 made up of one or more cores. In one non-limiting embodiment, the core assembly 84 includes multiple refractory metal cores (RMC's) 86 (i.e., a first core(s)) attached to a ceramic core 88 (i.e., a second core). This disclosure is not limited to RMCs and ceramic cores, however, and it should be understood that the core assembly 84 can be made up of cores of any size, shape, number and type. Once removed from the part 58 post-cast, such as via a leaching operation, the ceramic core 88 forms the internal cooling passages 74A, 74B of the part 58 and the RMC's 86 form the slots 78 and associated near-wall geometries of the internal circuitry 80 of the part 58 (see, e.g., FIG. 2).

Figure 4:
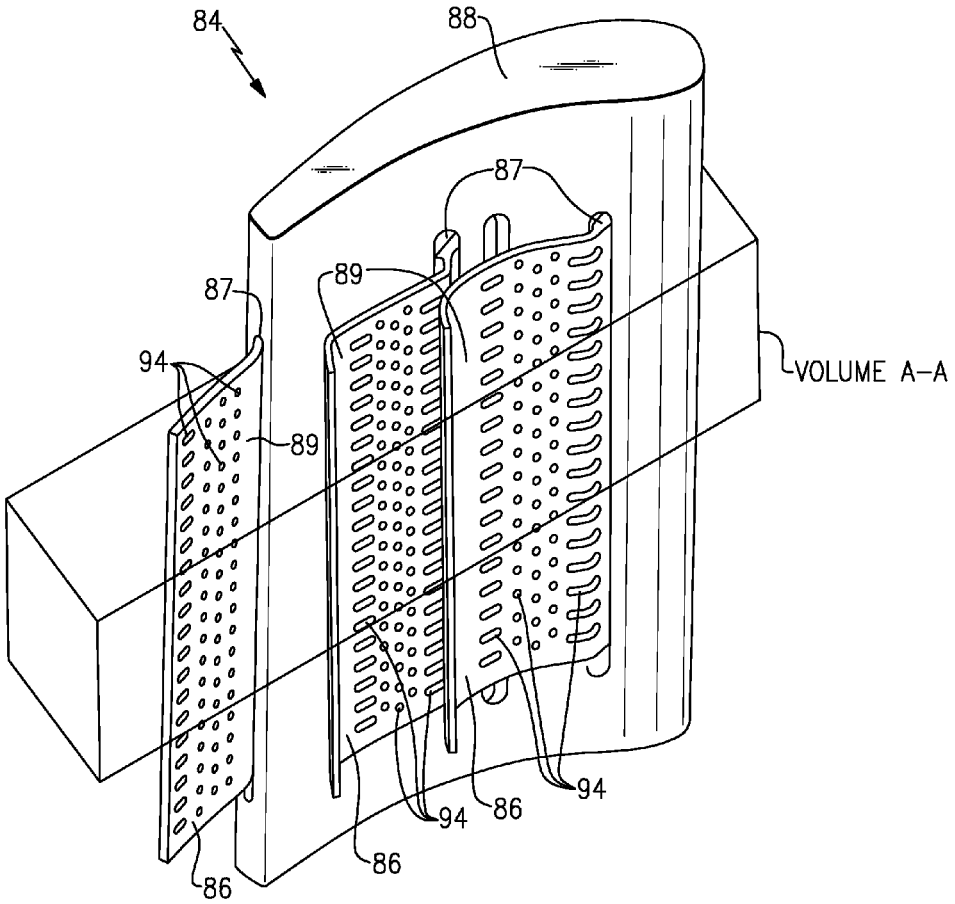
FIG. 4 illustrates a core assembly of a casting system.
Figure 5:
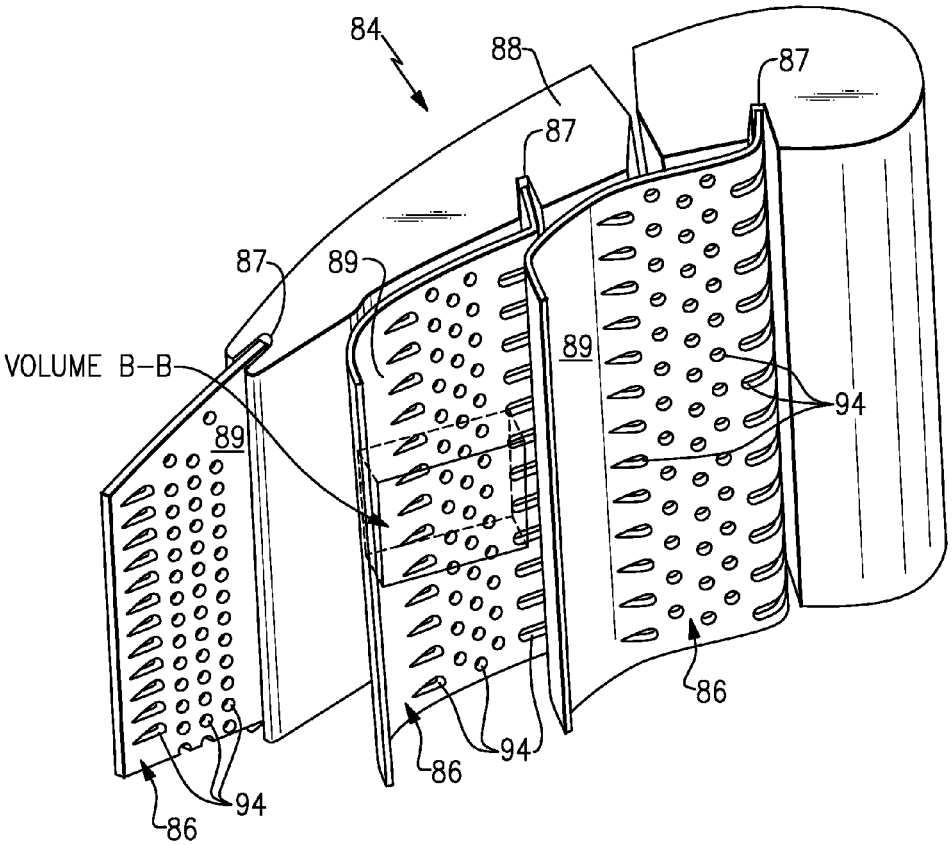
FIG. 5 illustrates volume A-A of the core assembly of FIG. 4.
Figure 6:
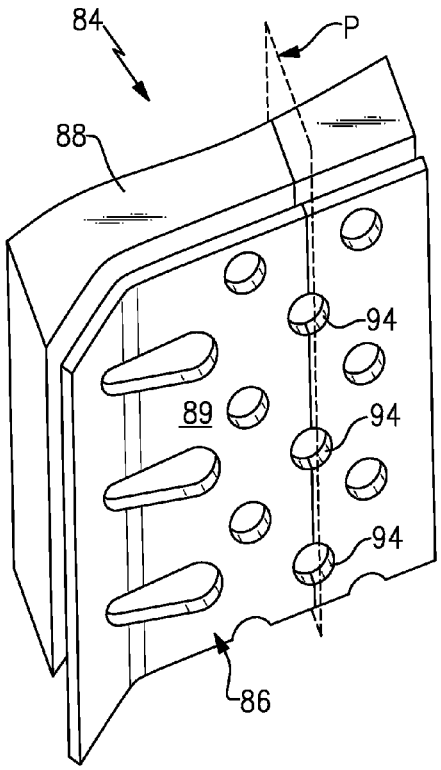
FIG. 6 illustrates volume B-B of FIG. 5.

FIGS. 4, 5 and 6, with continued reference to FIGS. 2-3, illustrate multiple features of the core assembly 84. For example, FIG. 4 illustrates the core assembly 84 with the wax pattern 82 of FIG. 3 removed, FIG. 5 depicts volume A-A of FIG. 4, and FIG. 6 depicts volume B-B of FIG. 5.

The RMC's 86 interface with troughs 87 formed in the ceramic core 88. The troughs 87 are receptacles for receiving the RMC's 86 to assemble the core assembly 84. The length, depth, geometry and configuration of the troughs 87 can vary and can be cast or machined into the ceramic core 88. The RMC's may include various holes 94 or other openings (formed through a body 89) that define pedestals and other features of the internal circuitry 80 ultimately cast into the part 58 of FIG. 2.

Figure 7A:
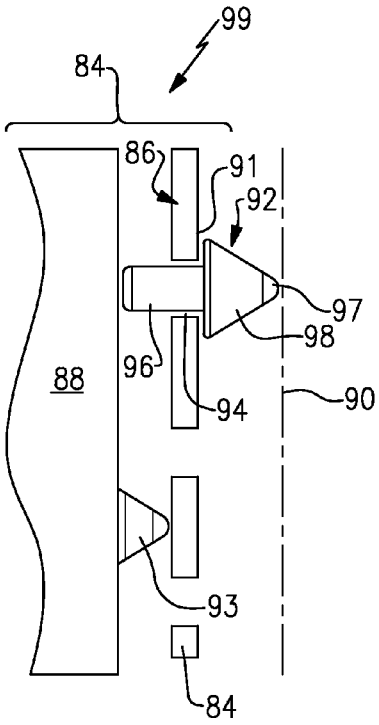
FIGS. 7A and 7B illustrate a view through a plane P of FIG. 6.

FIG. 7A illustrates a cross-sectional view of a casting system 99 that includes the core assembly 84 described above. The core assembly 84 of the casting system 99 is illustrated in this embodiment through plane P of FIG. 6. The casting system 99 may include the core assembly 84 and a shell 90 that generally surrounds the core assembly 84. The shell 90 may completely or partially surround the core assembly 84.

In one embodiment, a spacer 92 (also shown in FIG. 8) is received through a hole 94 formed in the RMC 86. Although only a single spacer 92 is illustrated in FIG. 7A, it should be understood that the core assembly 84 may employ a multitude of such spacers or any combination of spacers. The spacer 92 spaces and properly positions the RMC 86 relative to the shell 90. The spacer 92 may include a stud portion 96 and a chaplet portion 98. In one non-limiting embodiment, the stud portion 96 extends through the hole 94 toward the ceramic core 88 of the core assembly 84. The stud portion 96 may or may not contact the ceramic core 88.

Once the spacer 92 is positioned within the hole 94, the chaplet portion 98 may abut a surface 91 of the body 89 that generally circumscribes the hole 94 of the RMC 86. The chaplet portion 98 may extend to and abut against the shell 90. In one embodiment, a nose 97 of the chaplet portion 98 is in direct contact with the shell 90.

A bumper 93 may be formed on the ceramic core 88. The bumper 93 may be radially offset from the spacer 92 and extend in a direction toward the RMC 86. The bumper 93 maintains the spacing between the ceramic core 88 and the RMC 86 and helps to keep the spacer 92 from falling out of the hole 94 during the casting process.

Figure 7B:
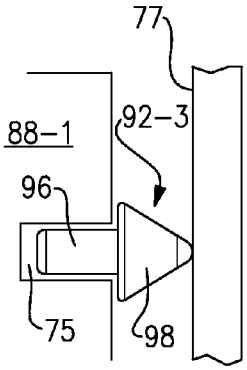

In an alternative embodiment, shown in FIG. 7B, another spacer 92-3 can be used in place of the bumper 93. A recess 75 may be formed in a core 88-1. The stud portion 96 of the spacer 92-3 may be inserted into the recess 75. The chaplet portion 98 spaces a surface 77, such as a surface of another core or a shell, from the core 88-1.

Figure 8:
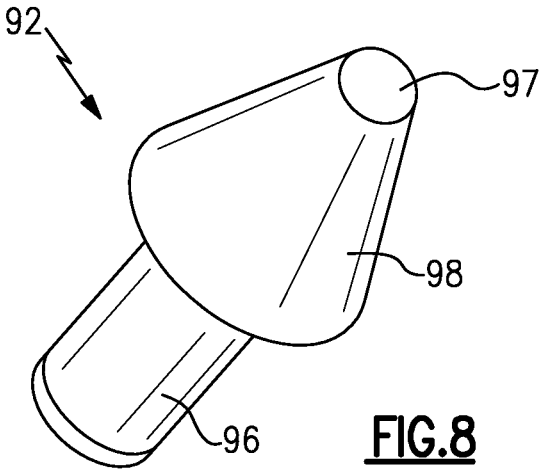
FIG. 8 illustrates a spacer that can be employed for use with a core assembly of a casting system.

FIG. 8 illustrates the spacer 92 described above in FIGS. 7A and 7B. As described, the spacer 92 includes a stud portion 96 and a chaplet portion 98 that extends from the stud portion 96. In one non-limiting embodiment, the chaplet portion 98 is conical. The spacer 92 may be made of platinum or a multi-metal composite, although other materials are also contemplated. One such multi-metal composite is made by OROFLEX PIN DEVELOPMENT LLC (see, e.g., U.S. Pat. No. 7,036,556, issued May 2, 2006).

Figure 9:
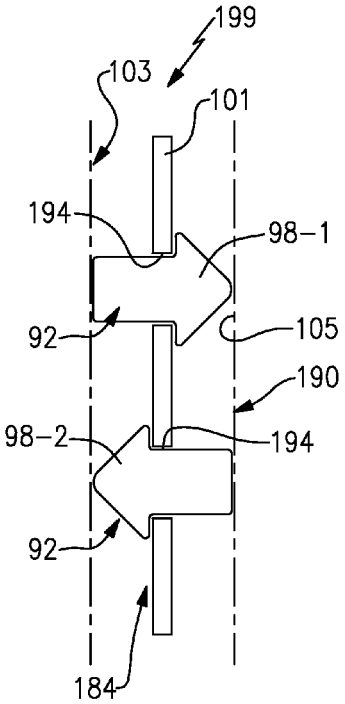
FIG. 9 illustrates another core assembly in which the spacer of FIG. 8 can be employed.

FIG. 9 illustrates another exemplary casting system 199. In this disclosure, like reference numbers designate like elements where appropriate and reference numerals with the addition of 100 or multiples thereof designate modified elements that are understood to incorporate the same features and benefits of the corresponding original elements.

In this embodiment, the casting system 199 may include a core assembly 184 that is at least partially surrounded by a shell 190. The core assembly 184 may include a first core 101. A surface 103 may be positioned adjacent to the first core 101 on an opposite side from the shell 190. In one embodiment, the first core 101 is a ceramic core or a RMC. In another embodiment, the surface 103 is part of either the shell 190 or a second core, such as a ceramic core.

Spacers 92 may be positioned to extend through holes 194 of the first core 101 to control a positioning of the first core 101 relative to both the surface 103 and the shell 190. In one embodiment, chaplet portions 98 of the spacers 92 are positioned to extend in opposing directions. In other words, a first chaplet portion 98-1 abuts a surface 105 of the shell 190 and a second chaplet portion 98-2 may abut the surface 103. Such a configuration may be particularly suited for use with cores that do not include the bumpers 93 shown in FIG. 7A, or for use with trailing edge cores, or between two adjacent RMC's.

Figure 10:
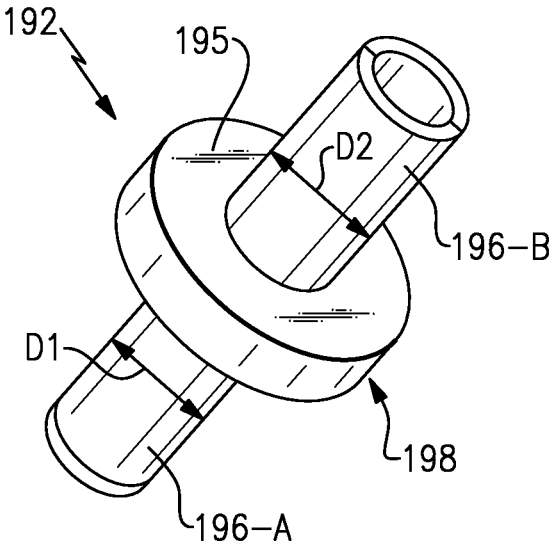
FIG. 10 illustrates a spacer according to a second embodiment of this disclosure.

FIG. 10 illustrates another exemplary spacer 192. In this embodiment, the spacer 192 includes a chaplet portion 198 that extends between a first stud portion 196-A and a second stud portion 196-B. The chaplet portion 198 may include a skirt 195. In one non-limiting embodiment, the skirt 195 is round. However, other shapes are also contemplated (see, for example, FIG. 12).

The first stud portion 196-A may include a first diameter D1 and the second stud portion 196-B may include a second diameter D2. In one embodiment, the second diameter D2 of the second stud portion 196-B is larger than the first diameter D1 of the first stud portion 196-A. The difference in the diameters D1, D2 helps ensure that the spacer 192 is properly positioned relative to the core assembly, such as by denoting to an assembler which stud portion is intended to abut against a shell of a casting system.

Figure 11:
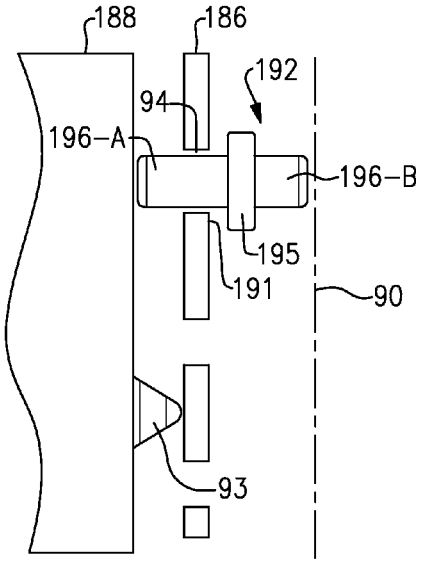
FIG. 11 illustrates an exemplary use of the spacer of FIG. 10.

Referring now to FIG. 11, the first stud portion 196-A of the spacer 192 may extend through the hole 94 of a first core 186 and extend toward a second core 188. The skirt 195 may abut a surface 191 of the first core 186. The second stud portion 196-B extends toward and may abut a shell 90. The second core 188 may optionally include a bumper 93.

Figure 12:
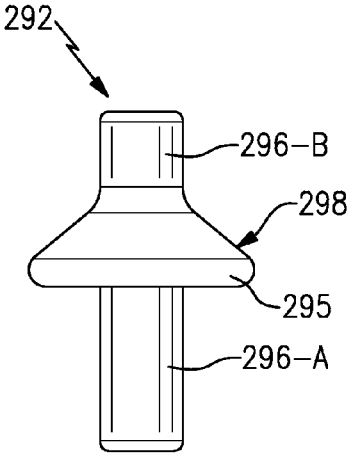
FIG. 12 illustrates a spacer according to a third embodiment of this disclosure.

Another non-limiting embodiment of a spacer 292 is illustrated in FIG. 12. The spacer 292 includes a chaplet portion 298 that extends between a first stud portion 296-A and a second stud portion 296-B. The chaplet portion 298 may include a skirt 295. In one non-limiting embodiment, the skirt 295 is conical. The sizes of the stud portions 296-A, 296-B may be tailored depending on the desired wall thickness of the part being cast.

Figure 13:
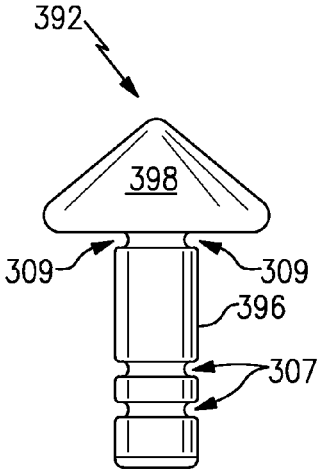
FIG. 13 illustrates a spacer according to a fourth embodiment of this disclosure.

FIG. 13 illustrates yet another spacer 392. The spacer 392 includes a stud portion 396 and a chaplet portion 398. The stud portion 396 may include one or more depth indicators 307. The depth indicators 307 indicate to an assembler different lengths for achieving different wall thicknesses in a cast part.

Figure 14:
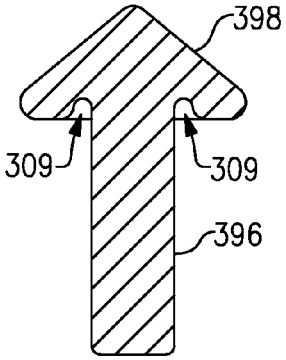
FIG. 14 illustrates a spacer according to another embodiment of this disclosure.

The spacer 392 may additionally include one or more filleted cutouts 309. The filleted cutouts 309 provide space for avoiding interference with the corners of a core that receives the spacer 392. In one embodiment, the filleted cutouts 309 are formed in the stud portion 396 (see FIG. 13). In another embodiment, the filleted cutouts 309 are formed in the chaplet portion 398 (See FIG. 14).

Figure 15:
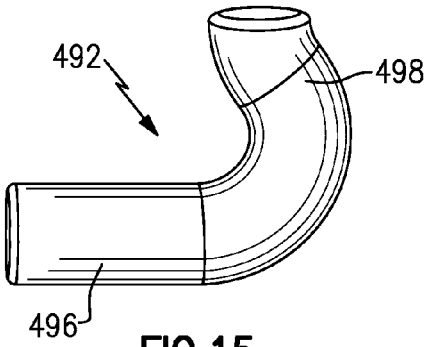
FIG. 15 illustrates a spacer according to yet another embodiment of this disclosure.

FIG. 15 illustrates yet another exemplary spacer 492. In this embodiment, the spacer 492 includes a stud portion 496 and a chaplet portion 498. The chaplet portion 498 may be formed by bending an end of the spacer 492 to a position that is transverse to the stud portion 496. For example, the spacer 492 may be made of a bendable platinum wire.

Figure 16:
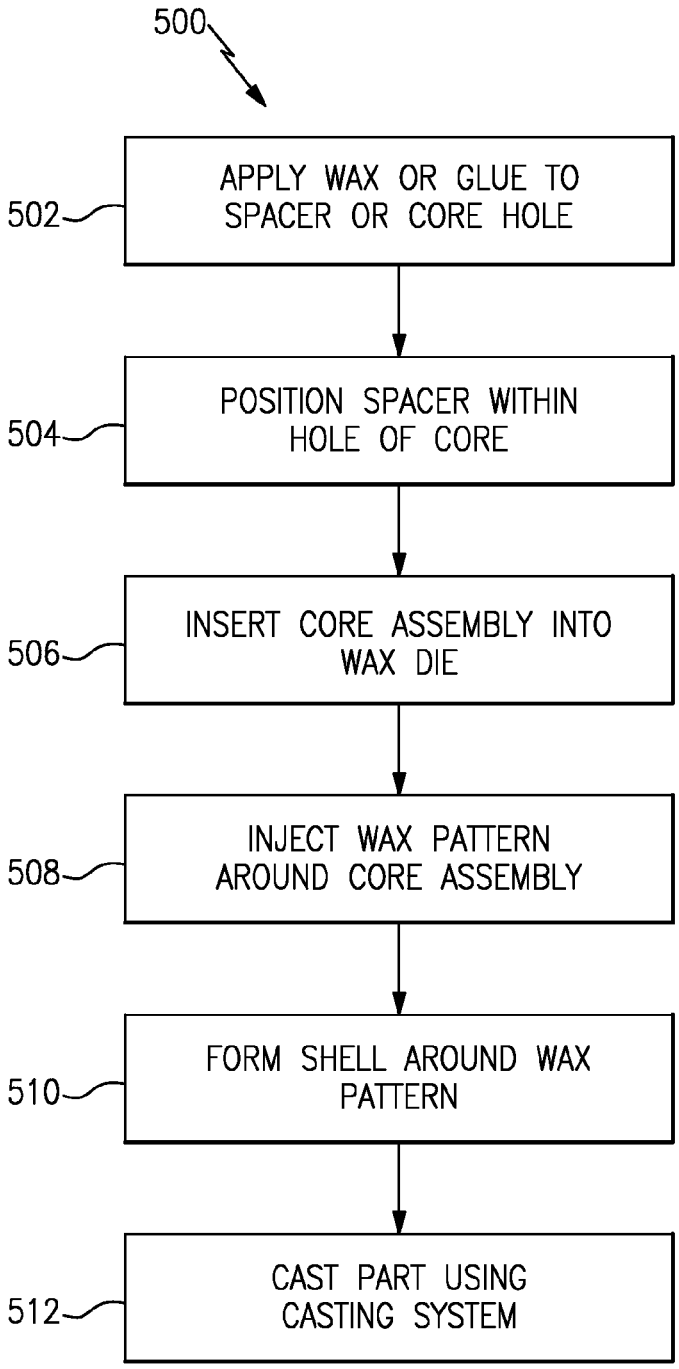
FIG. 16 schematically illustrates a casting method.

FIG. 16 schematically illustrates a casting method 500 that includes the use of a casting system that includes a core assembly. The exemplary method 500 may be utilized with respect to any of the casting systems, core assemblies and/or spacers described above.

First, at block 502, a wax or glue is applied to a spacer or to a hole in a first core (e.g., a RMC or ceramic core). A core assembly that includes at least the first core may optionally be assembled prior to block 502. For example, an RMC may be attached to a ceramic core.

At block 504, the spacer is positioned within the hole of the first core. The spacer is positioned such that a chaplet portion abuts a surface of the first core which surrounds the hole. The core assembly, including the spacer, is inserted into a wax die at block 506 and then a wax pattern is injected around the core assembly at block 508.

The shell is formed around the wax pattern at block 510 to construct the casting system. Once the shell has been formed, the wax pattern is burned or melted out leaving the core assembly and the spacers inside the shell. The spacers may contact the shell to space the first core therefrom. Finally, at block 512, molten metal is poured into the casting system to cast a part. The spacers maintain the proper spacing between the shell and the core assembly (or between cores) during the casting process to maintain wall thicknesses in the cast part. The core assembly may be leached out, with the metal of the spacers being incorporated into the final part alloy.

Figure 17:
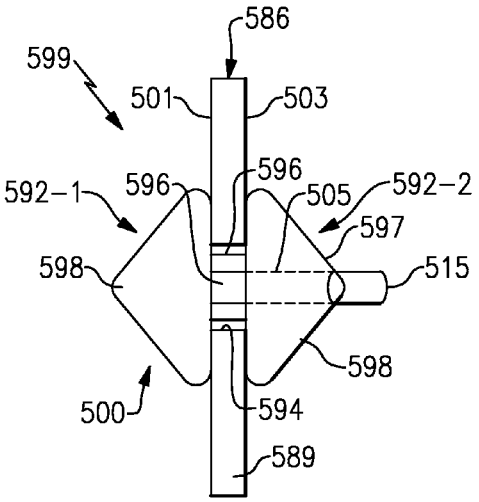
FIG. 17 illustrates a casting system that includes a spacer assembly according to a first embodiment of this disclosure.
Figure 18:
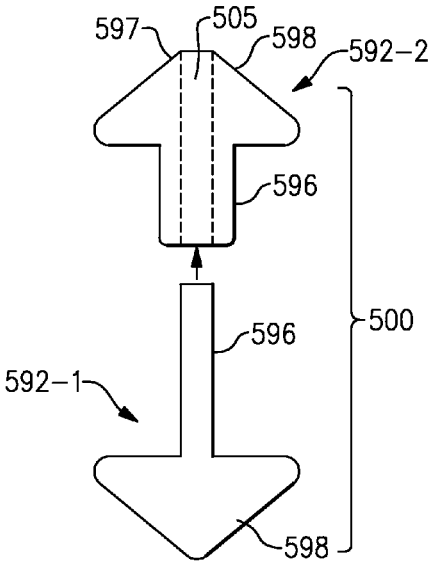
FIG. 18 illustrates the spacer assembly of FIG. 17.

FIGS. 17 and 18 illustrate portions of another casting system 599. In this embodiment, the casting system 599 utilizes a spacer assembly 500 that includes a first spacer 592-1 and a second spacer 592-2. The second spacer 592-2 may be secured relative to the first spacer 592-1 (or vice versa) to sandwich a core 586 of the casting system 599. The core 586 may be a RMC, a ceramic core or any other core. Although not shown, the core 586 may be positioned and/or assembled relative to other casting articles including but not limited to a shell or an additional core. The first spacer 592-1 and the second spacer 592-2 position and space the core 586 relative to adjacent casting articles.

In one embodiment, the first spacer 592-1 is positioned at a first side 501 of the core 586 and the second spacer 592-2 is positioned at a second side 503 of the core 586. Each spacer 592-1, 592-2 may be received within a hole 594 formed through a body 589 of the core 586. The first spacer 592-1 and the second spacer 592-2 may be inserted into the hole 594 of the core 586 in any order. That is, either the first spacer 592-1 or the second spacer 592-2 may be inserted into the hole 594 before the other spacer is engaged thereto. The hole 594 could be any opening, including a slotted opening.

The first spacer 592-1 and the second spacer 592-2 may both include a stud portion 596 and a chaplet portion 598. In one non-limiting embodiment, the second spacer 592-2 is engaged to the first spacer 592-1 by receiving the stud portion 596 of the first spacer 592-1 within a bore 505 that extends through the second spacer 592-2. Of course, an opposite configuration is also contemplated in which the first spacer 592-1 is equipped with a bore that receives the stud portion 596 of the second spacer 592-2.

Figure 19:
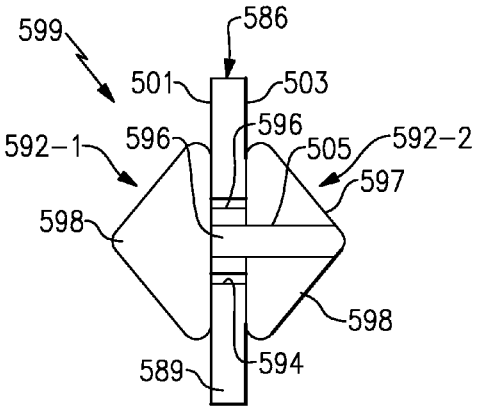
FIG. 19 illustrates another casting system that includes a spacer assembly according to another embodiment of this disclosure.

The bore 505 may extend completely through the second spacer 592-2, including through the stud portion 596 and the chaplet portion 598. In one embodiment, the stud portion 596 of the first spacer 592-1 extends beyond a nose 597 of the chaplet portion 598 of the second spacer 592-2 (see FIG. 17) such that an end 515 of the stud portion 596 protrudes out of the bore 505. In another embodiment, the stud portion 596 of the first spacer 592-1 extends to a position that is flush with the nose 597 of the chaplet portion 598 of the second spacer 592-2 (see FIG. 19).

In one embodiment, the first spacer 592-1 and the second spacer 592-2 are threadably connected to one another. In another embodiment, the first spacer 592-1 and the second spacer 592-2 are riveted to one another. The first spacer 592-1 and the second spacer 592-2 may be attached to one another using any attachment method to form the spacer assembly 500. Once the spacer assembly 500 is positioned to sandwich the core 586 by engaging the first spacer 592-1 to the second spacer 592-2 (or vice versa), the chaplet portions 598 may abut surfaces of the first side 501 and the second side 503 of the core 586 that generally circumscribe the hole 594. The two-sided spacer assembly 500 may reduce the likelihood of a spacer becoming displaced or dislodged from the core 586 during a casting procedure.

Although the different non-limiting embodiments are illustrated as having specific components, the embodiments of this disclosure are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should also be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A core assembly for a casting system, comprising:

a core that includes a body and at least one hole formed through said body;

a spacer including a stud portion that extends through said at least one hole, and including a chaplet portion having a larger diameter than said at least one hole, said chaplet portion configured to abut a surface of said body that circumscribes said at least one hole;

wherein said spacer is a first spacer and a second spacer, said second spacer engaging said first spacer to sandwich said core between said chaplet portion of said first spacer and said chaplet portion of said second spacer; and wherein said chaplet portion includes a conical body that tapers from a second end to a first end to define an apex at said first end, said second end configured to abut said surface, and said stud portion extending from said second end.

2. The core assembly as recited in claim 1, wherein said core is a refractory metal core (RMC).

3. The core assembly as recited in claim 1, wherein said core is a ceramic core.

4. The core assembly as recited in claim 1, wherein said spacer is made of platinum or a multi-metal composite.

5. The core assembly as recited in claim 1, comprising at least one filleted cutout formed in either said stud portion or said chaplet portion.

6. The core assembly as recited in claim 1, wherein said stud portion includes at least one depth indicator.

7. The core assembly as recited in claim 1, wherein said core is assembled to a second core and is spaced from said second core by a bumper or a third spacer.

8. The core assembly as recited in claim 1, wherein said core is assembled to a second core or a shell and is spaced from said second core or said shell by a third spacer received in a recess of said second core.

9. The core assembly as recited in claim 1, wherein said first spacer and said second spacer are threadably attached together.

10. The core assembly as recited in claim 1, wherein said first spacer and said second spacer are riveted together.

11. The core assembly as recited in claim 1, wherein said stud portion of said first spacer is received within a bore that extends through said chaplet and stud portions of said second spacer.

12. The core assembly as recited in claim 11, wherein said core is assembled to a second core and is spaced apart from said second core by said chaplet portion of said first spacer, and said core is assembled to a shell and is spaced apart from said shell by said chaplet portion of said second spacer.

13. The core assembly as recited in claim 12, wherein said first spacer and said second spacer are threadably attached together.

14. The core assembly as recited in claim 11, wherein said stud portion of said first spacer protrudes out of a first end of said bore, the first end of said bore opposed to a second end of said bore that is adjacent to said chaplet portion of said first spacer.

15. The core assembly as recited in claim 14, wherein said apex of said second spacer defines said first end of said bore such that said stud portion of said first spacer extends outwardly from said apex of said second spacer.

16. The core assembly as recited in claim 15, wherein said first spacer and said second spacer are threadably attached together.

17. The core assembly as recited in claim 1, wherein said spacer is made of a multi-metal composite.

18. A core assembly for a casting system, comprising:

a core that includes a body and at least one hole formed through said body;

a spacer including a stud portion that extends through said at least one hole, and including a chaplet portion having a larger diameter than said at least one hole, said chaplet portion configured to abut a sidewall of said body that circumscribes said at least one hole;

wherein said chaplet portion includes a skirt that is positioned intermediately between said stud portion and another stud portion to abut said sidewall; and wherein said skirt is rounded, and wherein said stud portion defines a first diameter, said another stud portion defines a second diameter that differs from said first diameter, and said skirt defines a third diameter that is greater than each of said first and second diameters.

* * * * *